US006276429B1

(12) United States Patent
Chen

(10) Patent No.: US 6,276,429 B1
(45) Date of Patent: Aug. 21, 2001

(54) WOVEN WINDOW SHADE

(76) Inventor: Yu-Hsiang Chen, No. 105, Sec. 3, Chiehshou Rd., Lukang Chen, Changhua Hsien (TW)

( * ) Notice: Subject to any disclaimer, the term of this patent is extended or adjusted under 35 U.S.C. 154(b) by 0 days.

(21) Appl. No.: 09/670,102

(22) Filed: Sep. 26, 2000

(51) Int. Cl.[7] ..... E06B 3/48
(52) U.S. Cl. ..... 160/231.1; 160/DIG. 7
(58) Field of Search ..... 160/236, 237, 160/243, DIG. 7, 231.1

(56) References Cited

U.S. PATENT DOCUMENTS 1,218,556 * 3/1917 Hough ..... 160/231.1
1,252,112 * 1/1918 Hough ..... 160/231.1
1,810,899 * 6/1931 Boehm ..... 160/231.1
2,244,300 * 6/1941 Kwon ..... 160/231.1
2,339,113 * 1/1944 Sarran et al. ..... 160/231.1
2,577,667 * 12/1951 Waite ..... 160/231.1 X
2,724,434 * 11/1955 Smith ..... 160/348
3,124,195 * 3/1964 Anderson ..... 160/231.1 X
3,581,799 * 6/1971 Bischoff ..... 160/231.1
4,240,490 * 12/1980 Ford ..... 160/133

* cited by examiner

*Primary Examiner*—David M. Purol
(74) *Attorney, Agent, or Firm*—Nixon Peabody LLP

(57) ABSTRACT

A woven window shade has multiple rods woven together by two weaving threads and at least one slat element formed from a herb plant separating adjacent rods. By such an arrangement, wind can pass through the gaps between adjacent slat element. This can keep the temperature of the shade from increasing and the inside environment from becoming sultry. In addition, the decoration versatility of the window shade is greatly improved.

1 Claim, 3 Drawing Sheets

WOVEN WINDOW SHADE

BACKGROUND OF THE INVENTION

1. Field of the Invention

The present invention relates to a window shade, and more particularly to a woven window shade fabricated from multiple twisted elements.

2. Description of Related Art

A window shade is used to block the sunlight and make the inside environment more comfortable for a user. With reference to FIG. 3, a conventional window shade in accordance with the prior art comprises multiple blind slats (30) woven together by two weaving threads (32). Each conventional blind slat (30) is a long, flat piece of wood or bamboo. The slats (30) in the conventional window shade effectively block the sunlight. However, the conventional wooden or bamboo shade is virtually airtight. The temperature of the blind slats (30) will increase after a period of time in sunlight, will trap heat and humidity inside and will cause the inside environment to be sultry. In addition, the conventional wooden or bamboo shade lacks decorative versatility.

To overcome the shortcomings, the present invention tends to provide an improved window shade to mitigate or obviate the aforementioned problems.

SUMMARY OF THE INVENTION

The main objective of the window shade in accordance with the present invention is to provide a woven window shade that will block sunlight and provide good ventilation. The window shade has multiple rods separately woven together by two weaving threads with at least one slat element of herb plant separating adjacent rods. This can keep the temperature of the shade from increasing and reduce the sultriness of the inside environment. In addition, the decorative versatility of the window shade can be improved.

Other objects, advantages and novel features ofthe invention will become more apparent from the following detailed description when taken in conjunction with the accompanying drawings.

DETAILED DESCRIPTION OF PREFERRED EMBODIMENT

Figure 1:
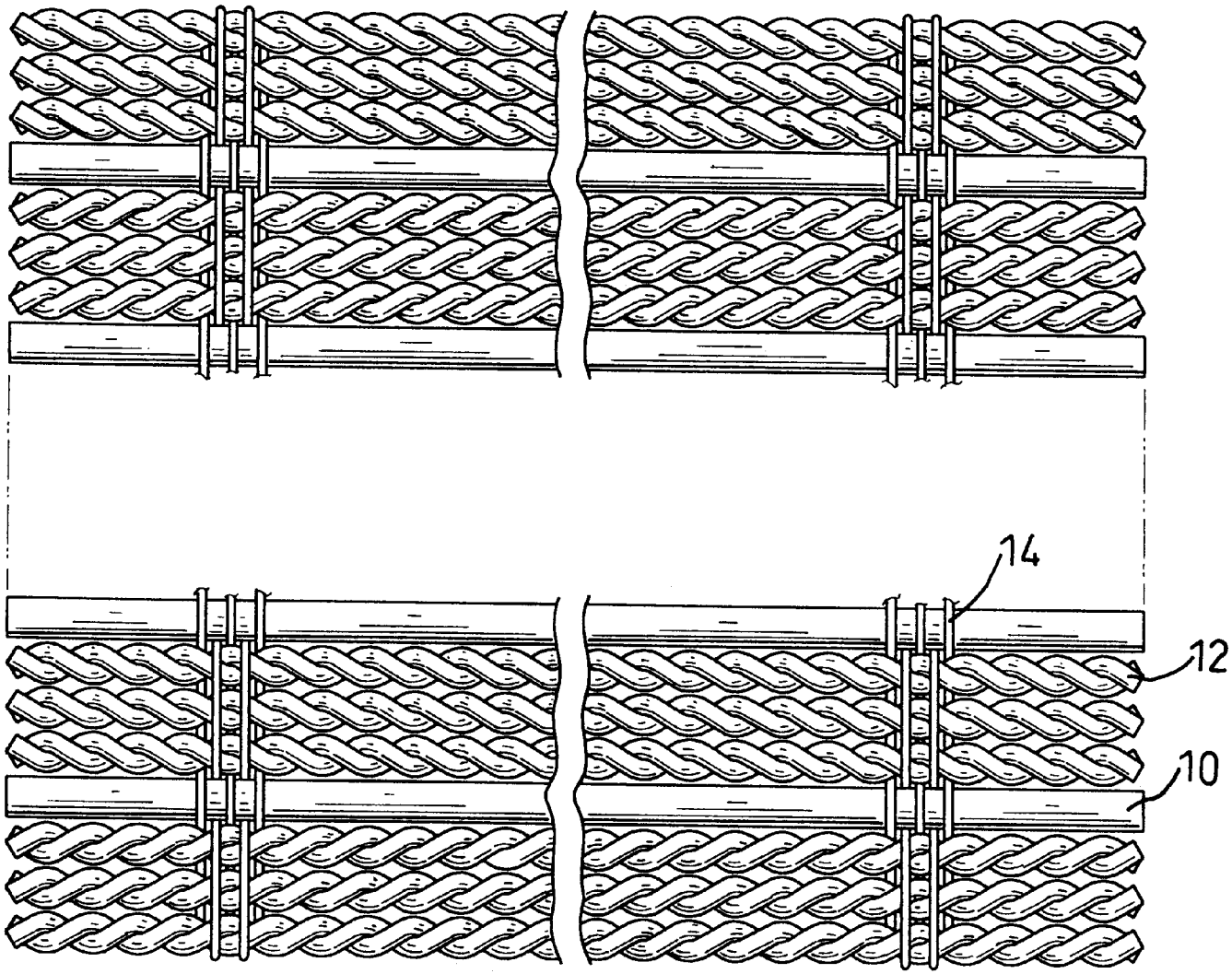
FIG. 1 is a front plan view of a woven window shade in accordance with the present invention.

With reference to FIG. 1, a window shade in accordance with the present invention comprises multiple rods (10) and at least one slat element (12) separating adjacent rods (10). The rods (10) are woven together by means of two weaving threads (14). The rods (10) provide support to the window shade when the shade is drawn up. Each slat element (12) would be a twist or a plait and constructed of a herb plant like straw or grass. The slat element (12) can be constructed by twisting at least two pieces of straw with each other to a twist.

With such a woven window shade, the sunlight is blocked by the slat elements (12), and wind can still pass through the gaps between adjacent twisted slat elements (12). This allows the window shade to provide good ventilation to keep the temperature of the shade from increasing. The inside environment will not be sultry.

Figure 2:
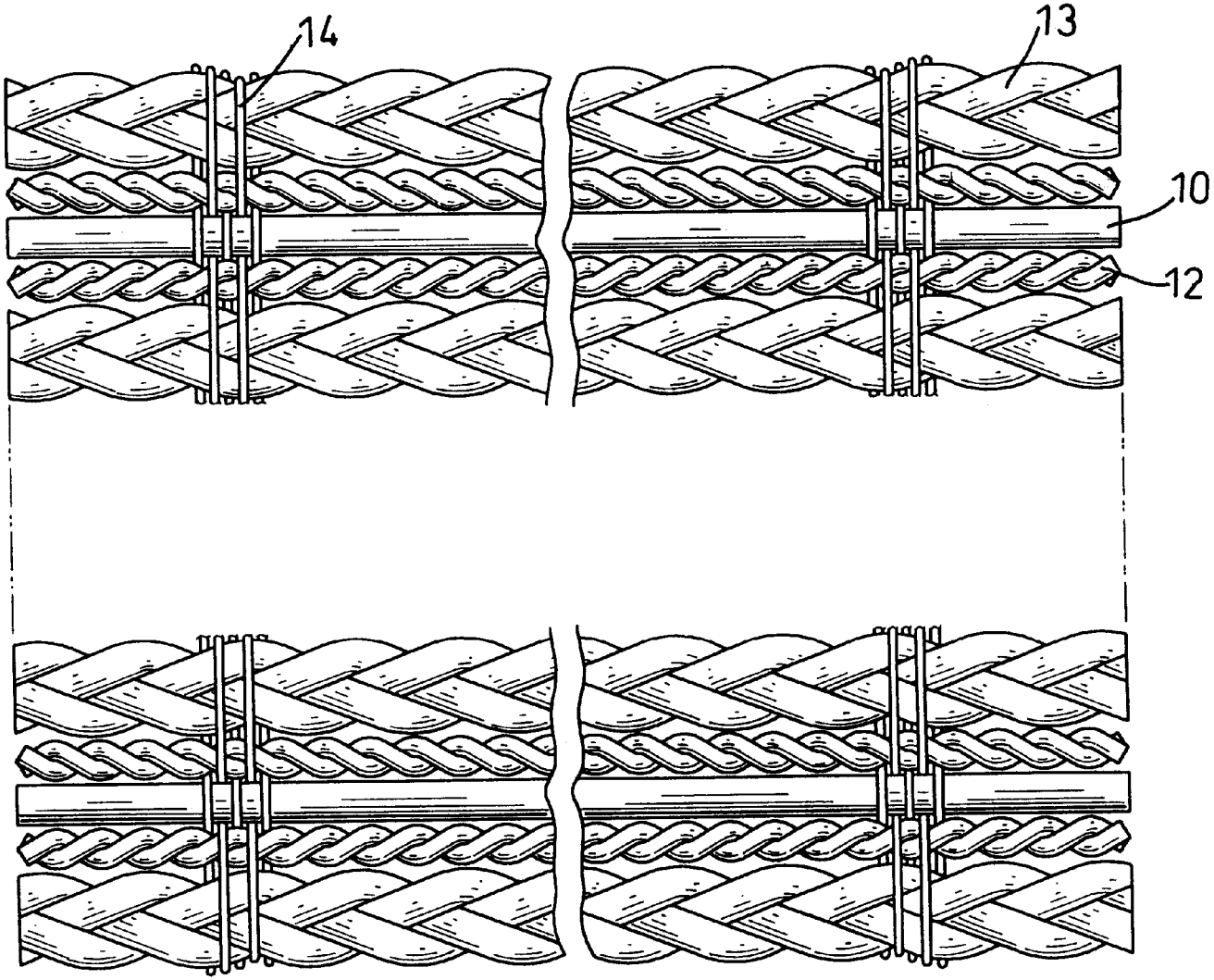
FIG. 2 is a front plan view of another embodiment of the window shade in accordance with the present invention.
Figure 3:
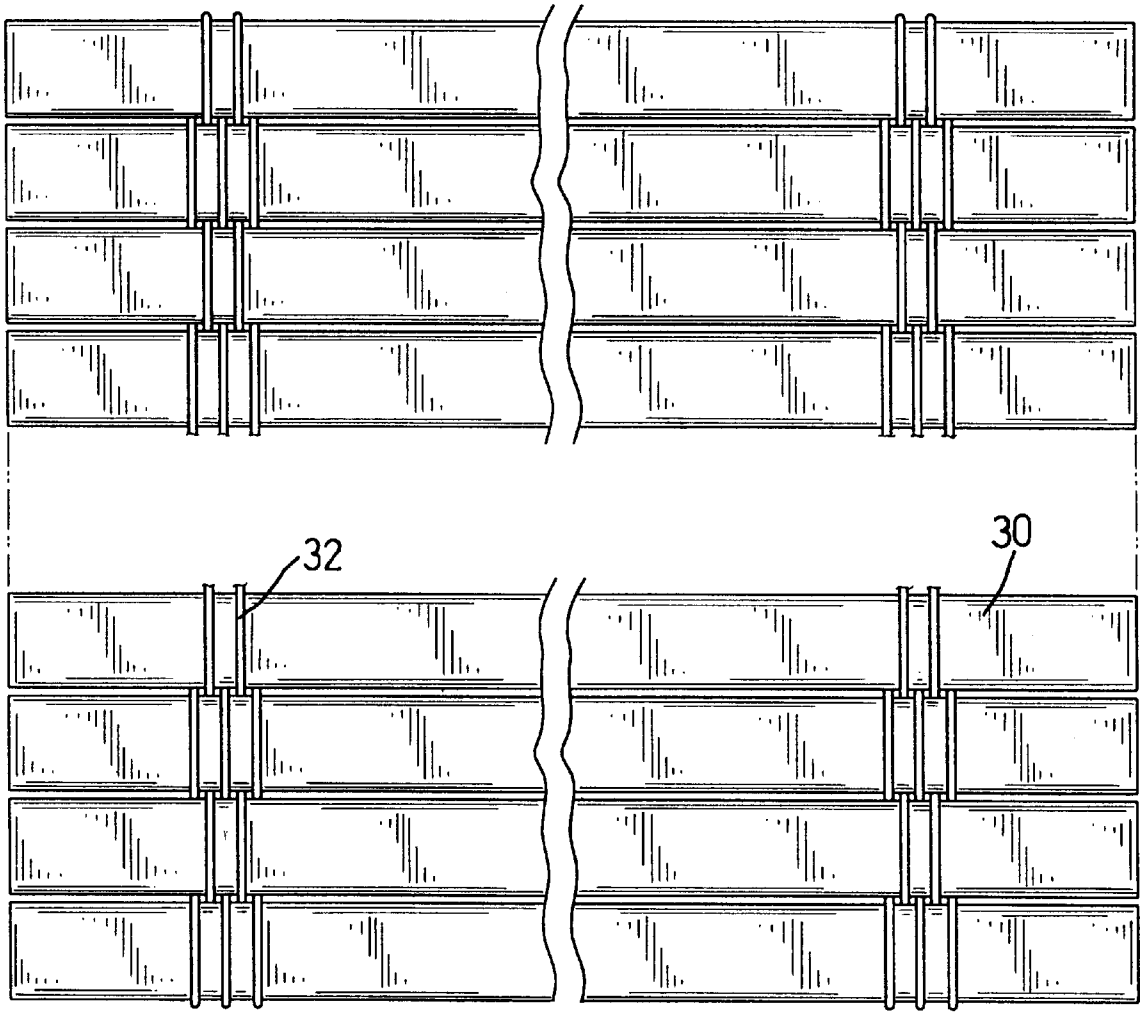
FIG.3 PRIOR ART
FIG. 3 is a front plan view of a conventional window shade in accordance with the prior art.

With reference to FIG. 2, in another embodiment of the window shade, one of the slat elements (13) is constructed by braiding pieces of straw together to a plait. Consequently, the slat elements (12,13) can be constructed in at least two different ways. This can improve the decorative versatility of the window shade. In addition, because a long slat element (12,13) can be made by the twisting or plaiting process, so the window shade can be made with a wide area.

It is to be understood, however, that even though numerous characteristics and advantages of the present invention have been set forth in the foregoing description, together with details of the structure and function of the invention, the disclosure is illustrative only, and changes may be made in detail especially in matters of shape, size, and arrangement of parts within the principles of the invention to the full extent indicated by the broad general meaning of the terms in which the appended claims are expressed.

What is claimed is:

1. A woven window shade comprising:

multiple rods woven together by means of two weaving threads; and slat elements formed of a herb plant separating adjacent rods, wherein one of the slat elements comprises at least two pieces of straw twisted together; and at least one of the slat elements comprises pieces of straw braided together.

* * * * *